US008220300B2

(12) United States Patent
Lee

(10) Patent No.: US 8,220,300 B2
(45) Date of Patent: Jul. 17, 2012

(54) THIN LOCK

(75) Inventor: Miko Lee, Hsin Chuang (TW)

(73) Assignee: ABA UFO International Corp., Hsin Chuang, Taipei Hsien (TW)

( * ) Notice: Subject to any disclaimer, the term of this patent is extended or adjusted under 35 U.S.C. 154(b) by 210 days.

(21) Appl. No.: 12/806,439

(22) Filed: Aug. 12, 2010

(65) Prior Publication Data

US 2012/0036903 A1 Feb. 16, 2012

(51) Int. Cl.
*E05B 65/00* (2006.01)

(52) U.S. Cl. ..... 70/387; 70/210; 70/214; 70/224; 70/350; 70/351; 70/352; 70/358; 70/361; 70/493

(58) Field of Classification Search ..... 70/210, 70/214, 224, 350–352, 358, 361, 387, 493
See application file for complete search history.

(56) References Cited

U.S. PATENT DOCUMENTS 1,113,193 A * 10/1914 Carroll ..... 70/284
1,503,565 A * 8/1924 Vives ..... 70/352
1,544,419 A * 6/1925 Bahun ..... 70/352
3,640,107 A * 2/1972 Litvin ..... 70/129
3,667,261 A * 6/1972 McGourty ..... 70/301
3,680,336 A * 8/1972 Schendel ..... 70/276
3,834,197 A * 9/1974 Sedley ..... 70/38 C
4,838,058 A * 6/1989 Matsumoto ..... 70/355
5,025,647 A * 6/1991 Muus ..... 70/352
5,291,766 A * 3/1994 Eisermann ..... 70/276
5,339,661 A * 8/1994 Eisermann ..... 70/276
5,442,941 A * 8/1995 Kahonen et al. ..... 70/34
5,653,134 A * 8/1997 Lee et al. ..... 70/276
5,669,254 A * 9/1997 Lee ..... 70/38 A
5,906,124 A * 5/1999 Su ..... 70/312
6,595,032 B2 * 7/2003 Lin ..... 70/352
7,444,844 B1 * 11/2008 Lee ..... 70/21

* cited by examiner

*Primary Examiner* — Lloyd Gall
*Assistant Examiner* — Ifeolu Adeboyejo
(74) *Attorney, Agent, or Firm* — Charles E. Baxley

(57) ABSTRACT

A thin lock has a housing, a core assembly mounted in the housing, multiple pin assemblies arranged longitudinally in the core assembly, and a latch assembly mounted through the housing and selectively activates the core assembly and the pin assemblies. Thus, when the thin lock is mounted on a door panel, numbers of the pin assemblies does not relate to a thickness of the door panel. Therefore, the numbers of the pin assemblies are able to be added to increase the complexity and enhance the safety of the thin lock according to user's need.

13 Claims, 14 Drawing Sheets

THIN LOCK

BACKGROUND OF THE INVENTION

1. Field of the Invention

The present invention relates to a thin lock, and more particularly to a thin lock that is especially adapted for thin door panel.

2. Description of the Prior Art(s)

A conventional pin tumbler lock has an outer lock core, an inner lock core and multiple pin assemblies. The outer lock core is tubular and has multiple pin recesses formed radially in an inner surface of the outer lock core and arranged axially along the outer lock core. The inner lock core is mounted in the outer lock core, and has a keyhole formed axially in an end of the inner lock core and multiple pin holes formed radially through the inner lock core, arranged axially along the inner lock core and respectively align with the pin recesses of the outer lock core. The pin assemblies are mounted respectively in corresponding pin recesses of the outer lock core and pin holes of the inner lock core. Each pin assembly has two pins of different lengths. When a key is inserted into the keyhole of the inner lock and pushes the pins to allow interfaces between corresponding pins are flush with an interface between the outer lock core and the inner lock core, the key is turnable to unlock the conventional pin tumbler lock. Moreover, the more the pin assemblies, the higher the complexity and safety of the conventional pin tumbler lock to prevent illegal ways to unlock the conventional pin tumbler lock.

As the conventional pin tumbler lock is mounted on a door panel, the conventional pin tumbler lock is disposed transversely between an interior surface and an exterior surface of the door panel. However, once the door panel is thin, lengths of the outer and inner lock cores must be shortened and numbers of the pin assemblies must be reduced accordingly. Consequently, complexity and safety of the conventional pin tumbler lock is lowered.

To overcome the shortcomings, the present invention provides a thin lock to mitigate or obviate the aforementioned problems.

SUMMARY OF THE INVENTION

The main objective of the present invention is to provide a thin lock. The thin lock has a housing, a core assembly mounted in the housing, multiple pin assemblies arranged longitudinally in the core assembly, and a latch assembly mounted through the housing and selectively activates the core assembly and the pin assemblies.

Thus, when the thin lock is mounted on a door panel, numbers of the pin assemblies does not relate to a thickness of the door panel. Therefore, the numbers of the pin assemblies are able to be added to increase the complexity and enhance the safety of the thin lock according to user's need.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
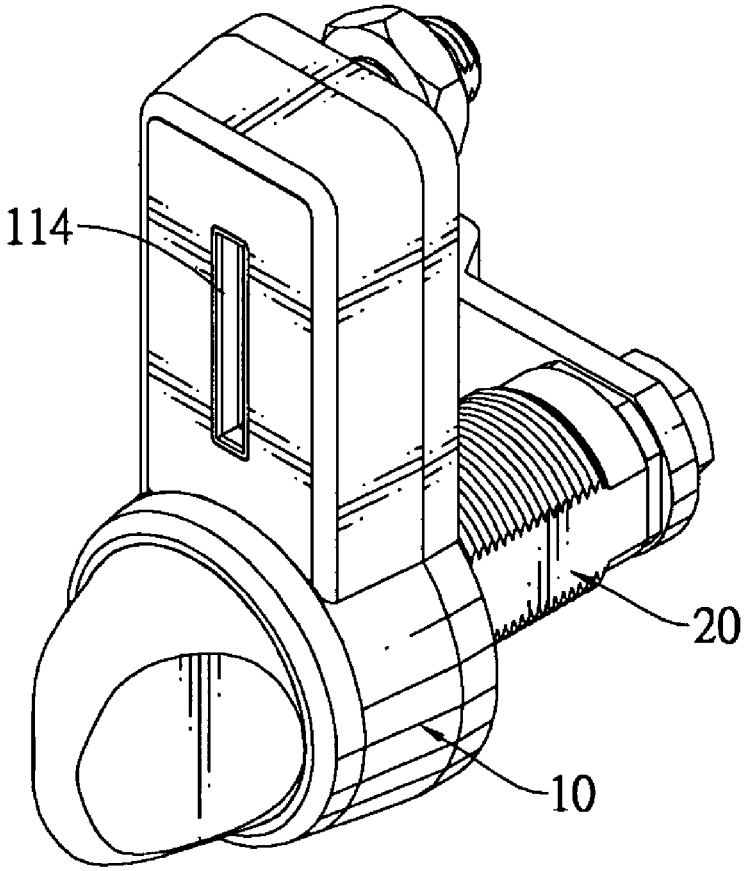
FIG. 1 is a perspective view of a first embodiment of a thin lock in accordance with the present invention.
Figure 2:
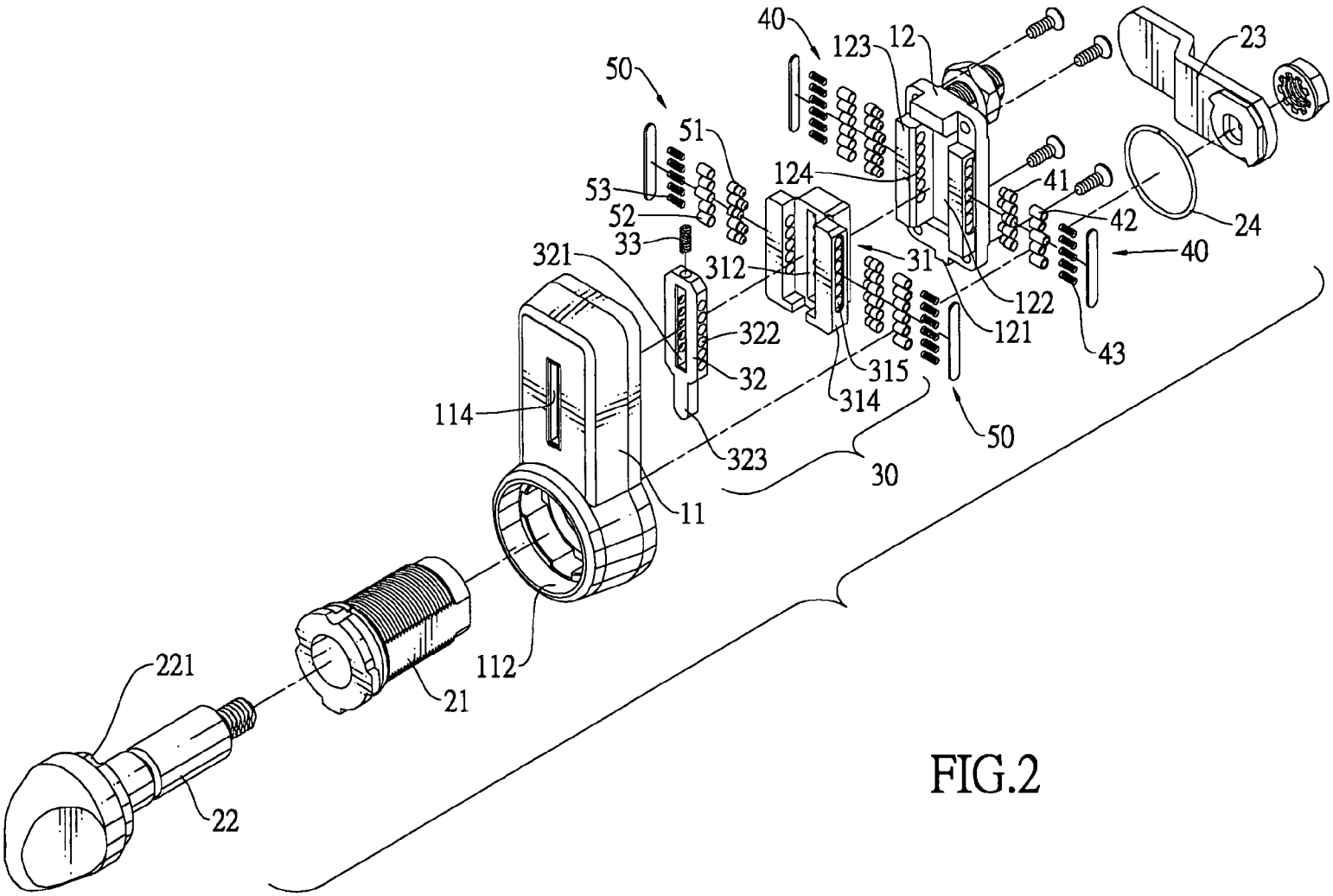
FIG. 2 is an exploded perspective view of the thin lock in FIG. 1.

With reference to FIGS. 1 and 2, in a first embodiment, a thin lock in accordance with the present invention comprises a housing 10, a latch assembly 20, a core assembly 30, a main resilient element 33, multiple first pin assemblies 40 and multiple second pin assemblies 50.

The housing 10 has a front half-housing 11 and a rear half-housing 12.

Figure 3:
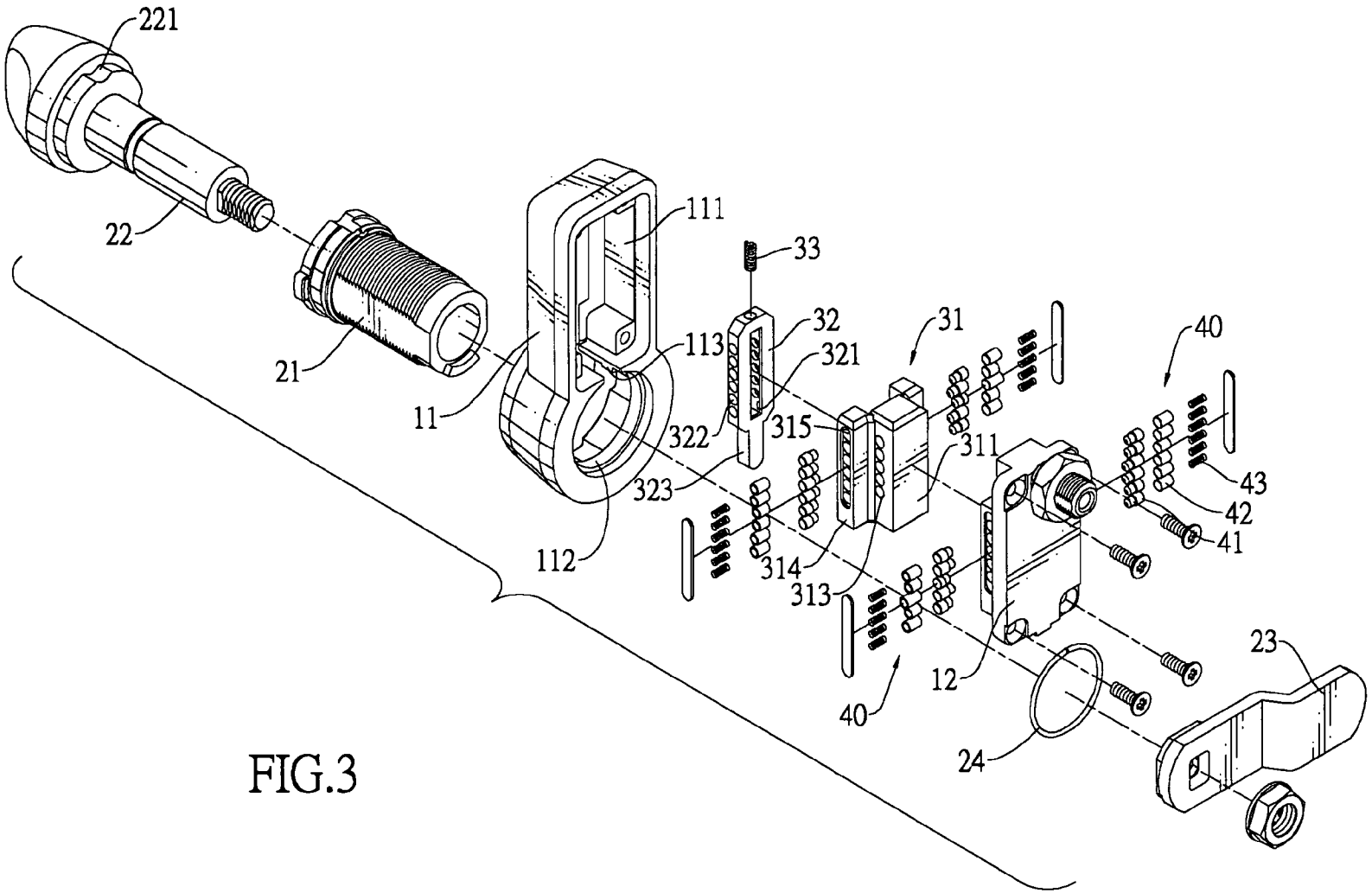
FIG. 3 is another exploded perspective view of the thin lock in FIG. 1.

With further reference to FIG. 3, the front half-housing 11 has a core recess 111, a latch hole 112, an inner peripheral surface, an inner wall, a through hole 113 and a keyhole 114. The core recess 111 is formed in the housing 10 and is formed in a rear surface of the front half-housing 11. The latch hole 112 is formed through the housing 10 and is formed through the front half-housing 11. The inner peripheral surface of the front half-housing 11 is defined around the latch hole 112. The inner wall of the front half-housing 11 is defined between the core recess 111 and the latch hole 112. The through hole 113 of the front half-housing 11 is formed through the inner wall of the front half-housing 11. The keyhole 114 of the front half-housing 11 is formed through a front surface of the housing 10, is formed through a front surface of the front half-housing 11 and corresponds to and communicates with the core recess 111.

The rear half-housing 12 is attached to the rear surface of the front half-housing 11, corresponds to the core recess 111 and has an inner surface, an aligning protrusion 121, a sliding recess 122 and at least one first pin mount 123. The inner surface of the rear half-housing 12 corresponds to the core recess 111 of the front half-housing 11. The aligning protrusion 121 protrudes down from a lower edge of the rear half-housing 12 and engages the through hole 113 of the front half-housing 11 so the rear half-housing 12 is attached to the front half-housing 11 in a specific direction. The sliding recess 122 is formed longitudinally in the inner surface of the rear half-housing 12. The at least one first pin mount 123 is formed longitudinally on the inner surface of the rear half-housing 12 and is disposed beside the sliding recess 122. Each of the at least one first pin mount 123 has multiple first pin recesses 124 formed separately in the at least one first pin mount 123 and arranged longitudinally along the at least one first pin mount 123.

The latch assembly 20 is mounted through the latch hole 112 of the front half-housing 11 and has a sleeve 21, a holding ring 24, a driving shaft 22 and a locking device 23. The sleeve 21 is mounted through the latch hole 112 of the front half-housing 11 and has a front and a rear. The front of the sleeve 21 engages the inner peripheral surface of the front half-housing 11. The rear of the sleeve 21 protrudes toward and out of the rear surface of the front half-housing 11. The holding ring 24 is mounted securely around the sleeve 21 and abuts the inner peripheral surface of the front half-housing 11 to hold the sleeve 21 securely on the front half-housing 11. The driving shaft 22 is mounted rotatably through the latch hole 112 of the front half-housing 11 and the sleeve 21 and has a front, a rear and at least one lock recess 221. The front of the driving shaft 22 protrudes toward and out of the front surface of the front half-housing 11. The at least one lock recess 221 is formed in a peripheral surface of the driving shaft 22 and corresponds to the through hole 113 of the front half-housing 11. The locking device 23 is disposed on the rear of the sleeve 21 and is attached to the rear of the driving shaft 22. Thus, when the driving shaft 22 turns, the locking device 23 is driven accordingly to lock or unlock a door panel.

The core assembly 30 is mounted slidably in the core recess 111 of the front half-housing 11 and has a first core 31, a second core 32 and lock protrusion 323.

The first core 31 is mounted slidably adjacent to the rear half-housing 12 and has a middle pin mount 311 and at least one second pin mount 314. The middle pin mount 311 is mounted in the sliding recess 122, corresponds to the at least one first pin mount 123 of the rear half-housing 12 and has a key recess 312 and multiple first pin holes 313. The key recess 312 is formed longitudinally in a front surface of the middle pin mount 311. The first pin holes 313 are formed through the middle pin mount 311 and respectively align with the first pin recesses 124 of the at least one first pin mount 123. The at least one second pin mount 314 is formed longitudinally on a front surface of the middle pin mount 311 and is disposed beside the key recess 312. Each of the at least one second pin mount 314 has multiple second pin recesses 315 formed separately in the at least one second pin mount 314 and arranged longitudinally along the at least one second pin mount 314.

The second core 32 is mounted slidably adjacent to the front half-housing 11, corresponds to the at least one second pin mount 314 of the first core 31 and has a keyhole 321, an inner surface and multiple second pin holes 322. The keyhole 321 of the second core 32 is formed longitudinally through the second core 32 and aligns with the key recess 312 of the middle pin mount 311 of the first core 31 and the keyhole 114 of the front half-housing 11. The inner surface of the second core 32 is defined around the keyhole 321 of the second core 32. The second pin holes 322 are formed through the inner surface of the second core 32 and respectively align with the second pin recesses 315 of the at least one second pin mount 314.

The lock protrusion 323 protrudes down from a lower edge of the core assembly 30, protrudes down from a lower edge of the second core 32 of the core assembly 30, is mounted through the through hole 113 of the front half-housing 11, abuts the driving shaft 22 of the latch assembly 20 and selectively engages the at least one lock recess 221 of the driving shaft 22 so the driving shaft 22 is held and is not rotatable.

The main resilient element 33 is mounted between an upper edge of the second core 32 and the front half-housing 11 and has two ends respectively abutting the second core 32 and the front half-housing 11 to push the second core 32 so the second core 32 tightly abuts the driving shaft 22.

Figure 4:
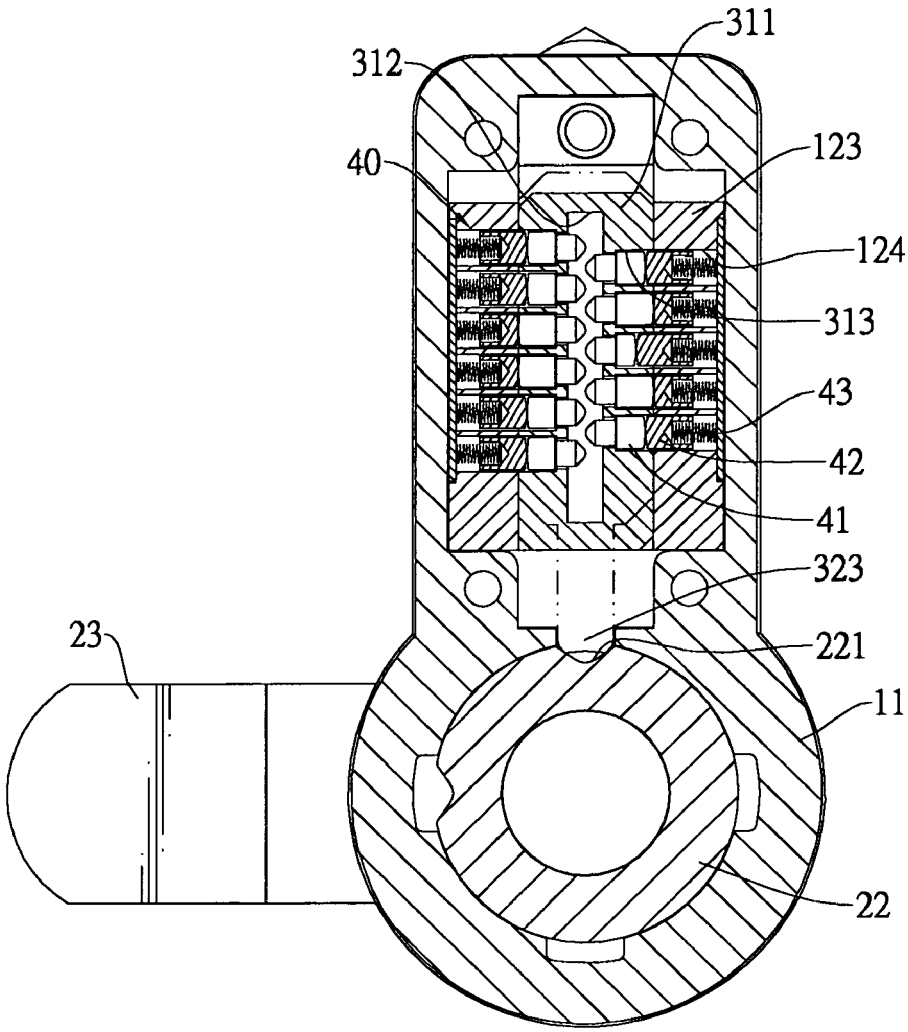
FIG. 4 is a front view in partial section of the thin lock in FIG. 1.

With further reference to FIG. 4, the first pin assemblies 40 are mounted respectively in the first pin recesses 124 of the rear half-housing 12 and the first pin holes 313 of the first core 31 of the core assembly 30. Each first pin assembly 40 has a first outer pin 41, a first inner pin 42 and a first resilient element 43. The first outer pin 41 is mounted in the first pin hole 313 of the first core 31 of the core assembly 30. The first inner pin 42 is mounted in the first pin recess 124 of the rear half-housing 12. The first resilient element 43 is mounted in the first pin recess 124 of the rear half-housing 12 and has two ends respectively abutting the at least one first pin mount 123 and the first inner pin 42 to push the first inner pin 42 and the first outer pin 41 so part of the first inner pin 42 further protrudes into the first pin hole 313 of the first core 31.

Figure 6:
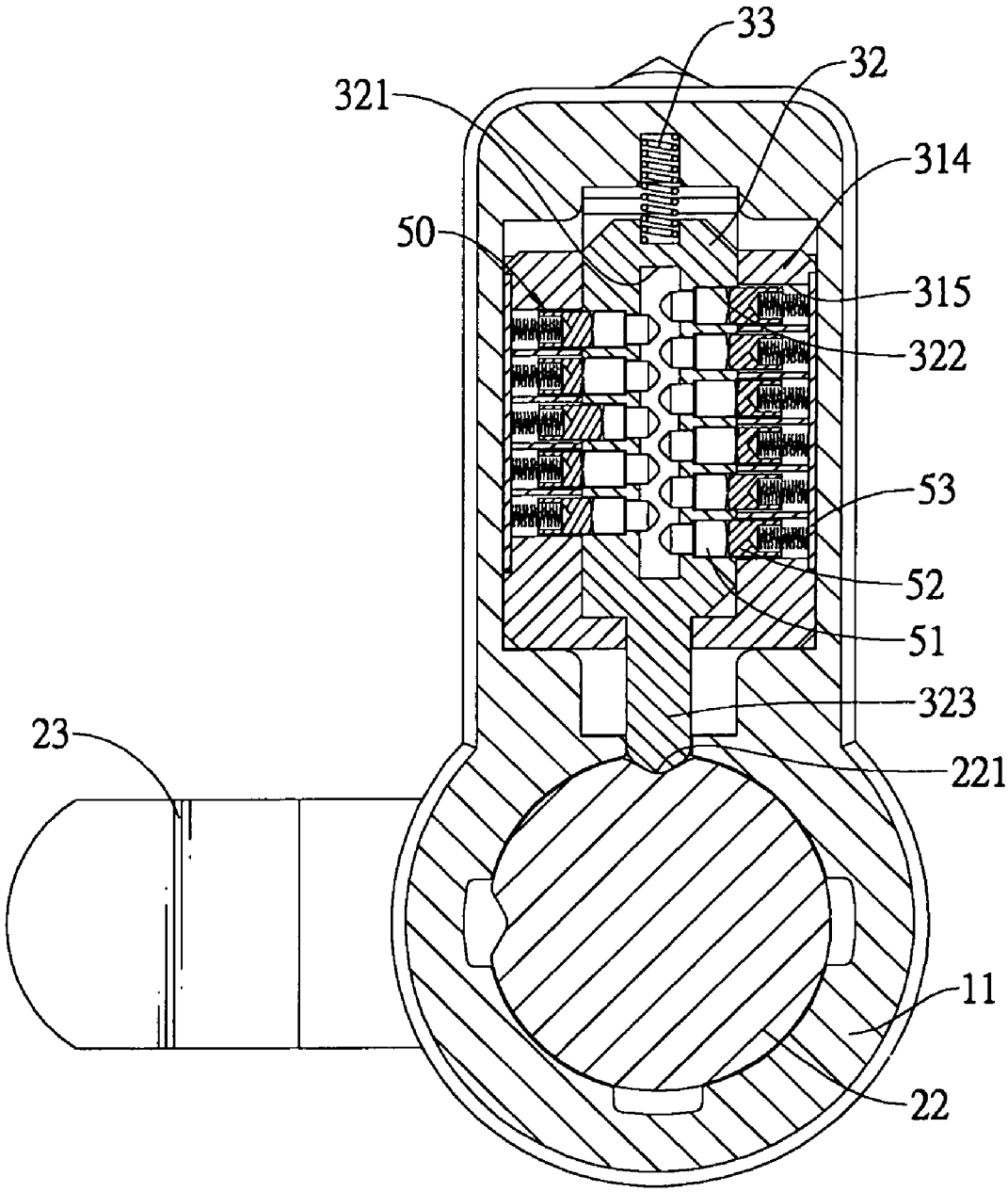
FIG. 6 is another front view in partial section of the thin lock in FIG. 1.

With further reference to FIG. 6, the second pin assemblies 50 are mounted respectively in the second pin recesses 315 of the first core 31 and the second pin holes 322 of the second core 32. Each second pin assembly 50 has a second outer pin 51, a second inner pin 52 and a second resilient element 53. The second outer pin 51 is mounted in the second pin hole 322 of the second core 32. The second inner pin 52 is mounted in the second pin recess 315 of the first core 31. The second resilient element 53 is mounted in the second pin recess 315 of the first core 31 and has two ends respectively abutting the at least one second pin mount 314 and the second inner pin 52 to push the second inner pin 52 and the second outer pin 51 so part of the second inner pin 52 further protrudes into the second pin hole 322 of the second core 32.

In a preferred embodiment of the first embodiment of the thin lock, the rear half-housing 12 has two first pin mounts 123 and the first core 31 has two second pin mounts 314. Each first pin mounts 123 has a side surface corresponding to the side surface of the other first pin mount 123. The first pin recesses 124 of each first pin mount 123 are formed in the side surface of the first pin mount 123. The middle pin mount 311 of the first core 31 is mounted between the first pin mounts 123. The second pin mounts 314 are formed respectively beside two opposite sides of the key recess 312 of the first core 31. Each second pin mount 314 has a side surface corresponding to the side surface of the other second pin mount 314. The second pin recesses 315 of each second pin mount 314 are formed in the side surface of the second pin mount 314. The second core 32 is mounted between the second pin mounts 314.

Figure 8:
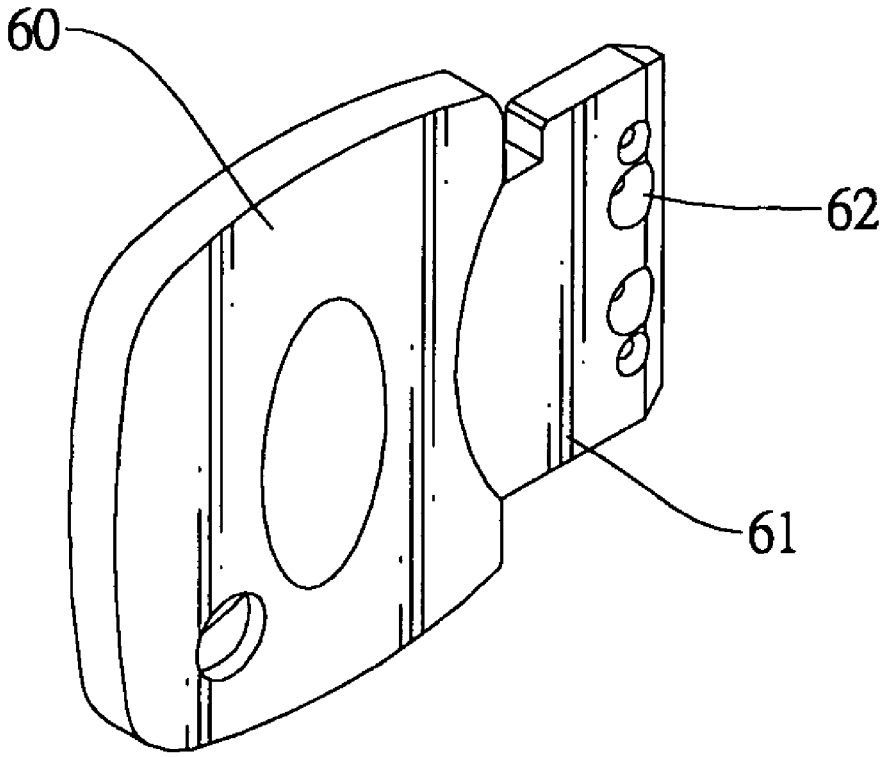
FIG. 8 is a perspective view of a key to the thin lock of the present invention.

With further reference to FIG. 8, a first key 60 to the thin lock as described has a lock panel 61. The lock panel 61 has two opposite side surfaces and multiple first teeth 62 formed in the side surfaces of the lock panel 61. When the lock panel 61 of the first key 60 is inserted through the keyholes 114, 321 of the front half-housing 11 and the second core 32 and the key recess 312 of the first core 31, the first teeth 62 of the first key 60 respectively correspond to the first pin holes 313 of the first core 31 and the first pin assemblies 40 mounted in the first pin holes 313.

Figure 5:
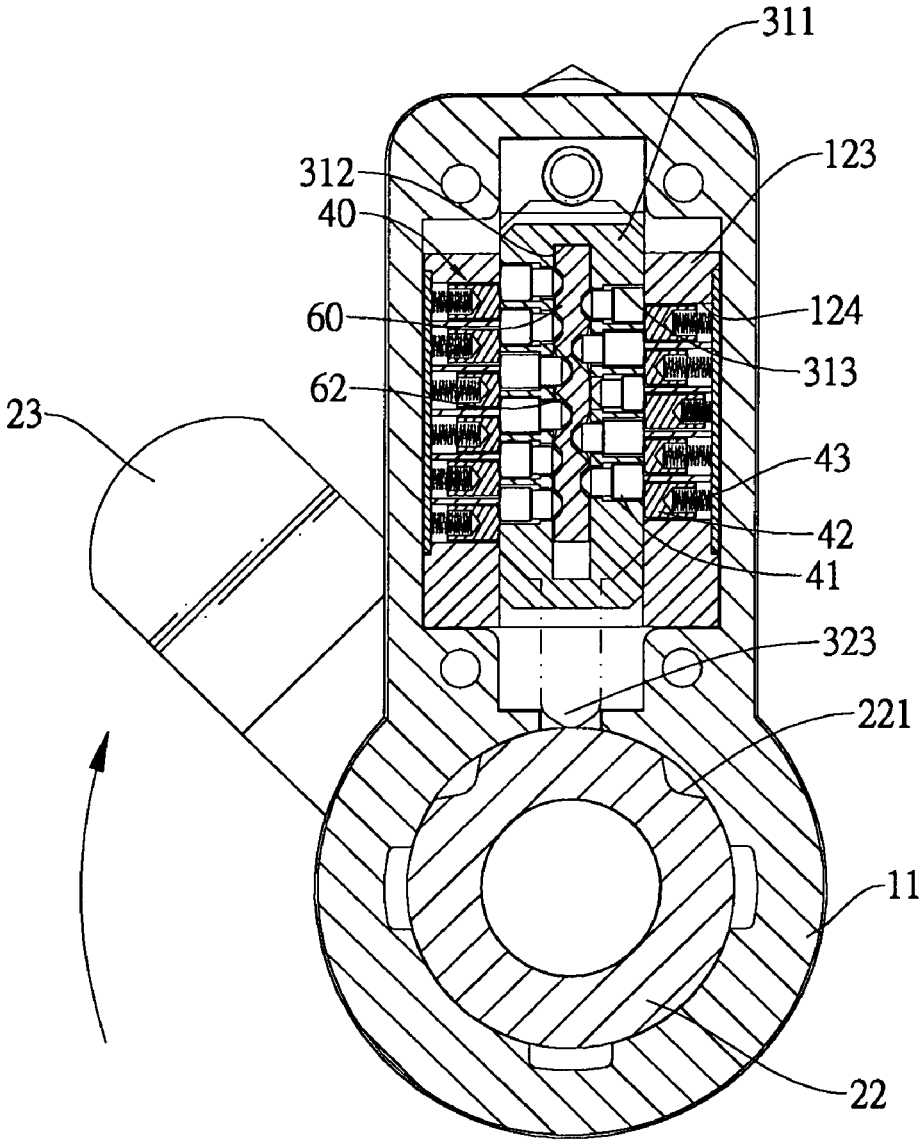
FIG. 5 is an operational front view in partial of the thin lock in FIG. 1, shown unlocked.

Thus, with further reference to FIG. 5, bottoms defined in the first teeth 62 of the first key 61 respectively push the first outer pins 41 and the first inner pins 42 so interfaces between the first outer pins 41 and the first inner pins 42 are flush with corresponding at least one interface between the at least one first pin mount 123 of the rear half-housing 12 and the middle pin mount 311 of the first core 31. Then, the first core 31 is slidable relative to the housing 10 and the driving shaft 22 of the latch assembly 20 is turnable. The thin lock is unlocked. Besides, since no teeth of the first key 60 corresponds to the keyhole 321 of the second core 32, relative positions of the first core 31 and the second core 32 are still held by the second pin assemblies 50. As the driving shaft 22 of the latch assembly 20 turns, the first core 31 and the second core 32 slides simultaneously relative to the housing 10.

Figure 9:
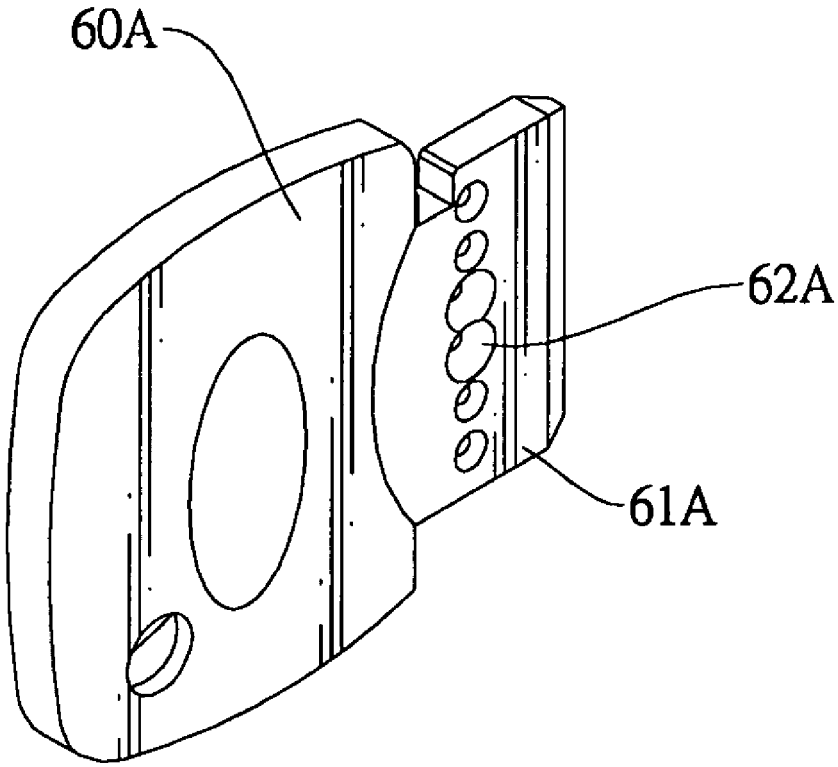
FIG. 9 is a perspective view of another key to the thin lock of the present invention.

With further reference to FIG. 9, a second key 60A to the thin lock as described has a lock panel 61A. The lock panel 61A has two opposite side surfaces and multiple second teeth 62A formed in the side surfaces of the lock panel 61A. When the lock panel 61A of the second key 60A is inserted through the keyholes 114, 321 of the front half-housing 11 and the second core 32 and the key recess 312 of the first core 31, the second teeth 62A of the second key 60A respectively correspond to the second pin holes 322 of the second core 32 and the second pin assemblies 50 mounted in the second pin holes 322.

Figure 7:
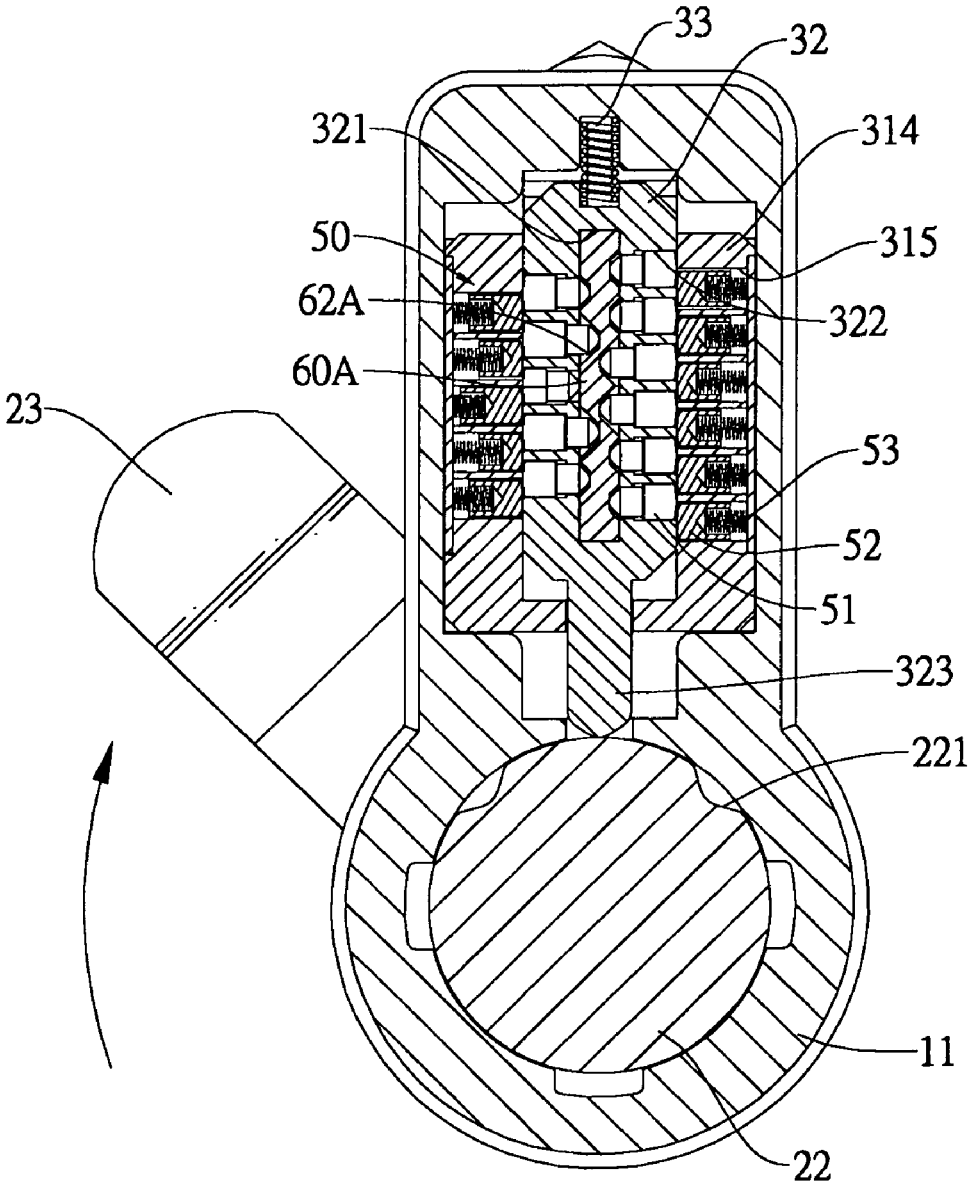
FIG. 7 is another operational front view in partial of the thin lock in FIG. 1, shown unlocked.

Thus, with further reference to FIG. 7, bottoms defined in the second teeth 62A of the second key 60A respectively push the second outer pins 51 and the second inner pins 52 so interfaces between the second outer pins 51 and the second inner pins 52 are flush with corresponding at least one interface between the at least one second pin mount 314 of the first core 31 and the second core 32. Then, the second core 32 is slidable relative to the first core 31 and the driving shaft 22 of the latch assembly 20 is turnable. The thin lock is unlocked. Besides, since no teeth of the second key 60A corresponds to the key recess 312 of the first core 31, relative positions of the first core 31 and the rear half-housing 12 are still held by the first pin assemblies 40. As the driving shaft 22 of the latch assembly 20 turns, the second core 31 slides relative to the first core 31 and the housing 10.

Figure 10:
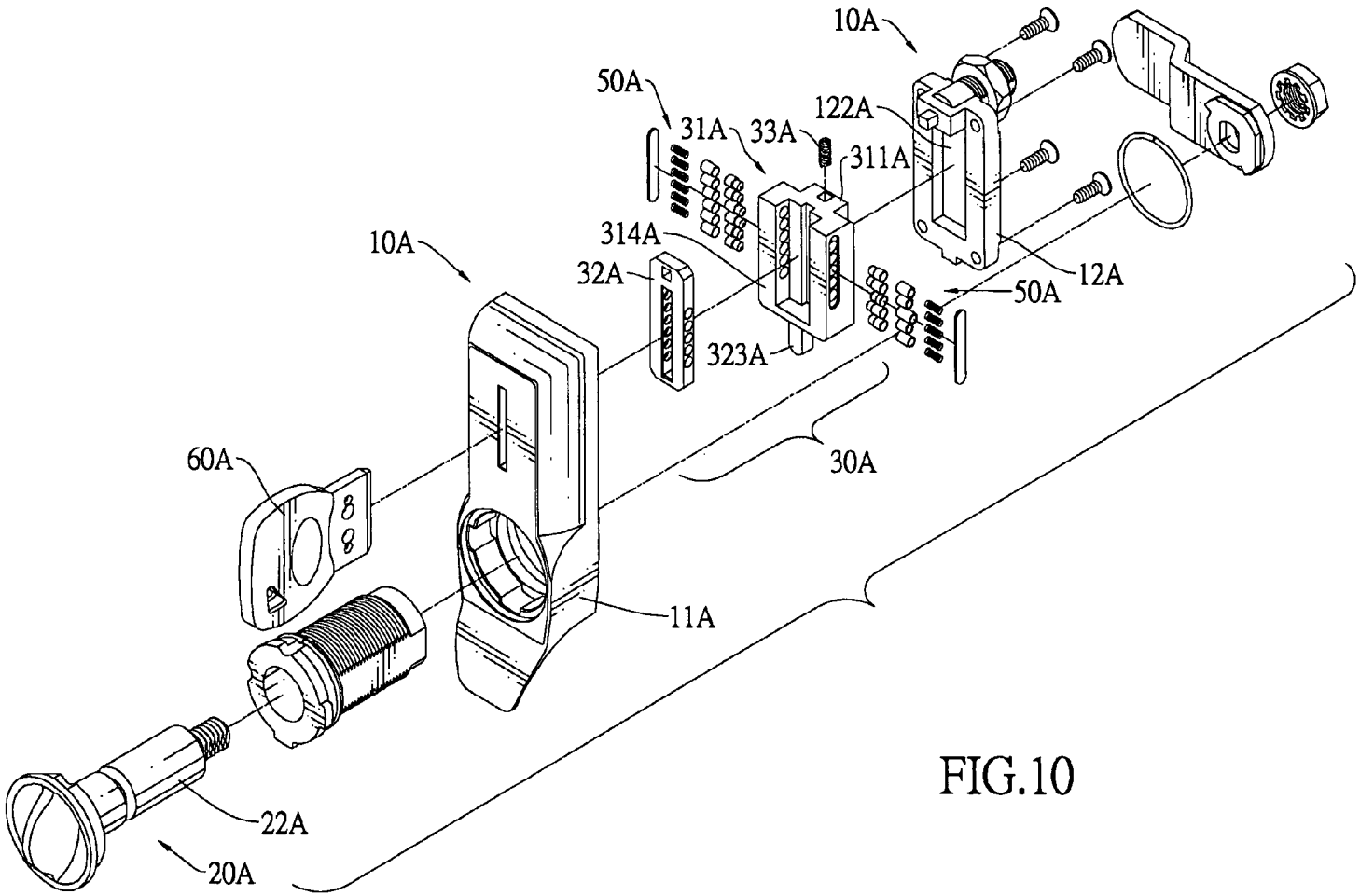
FIG. 10 is an exploded perspective view of a second embodiment of a thin lock in accordance with the present invention.
Figure 11:
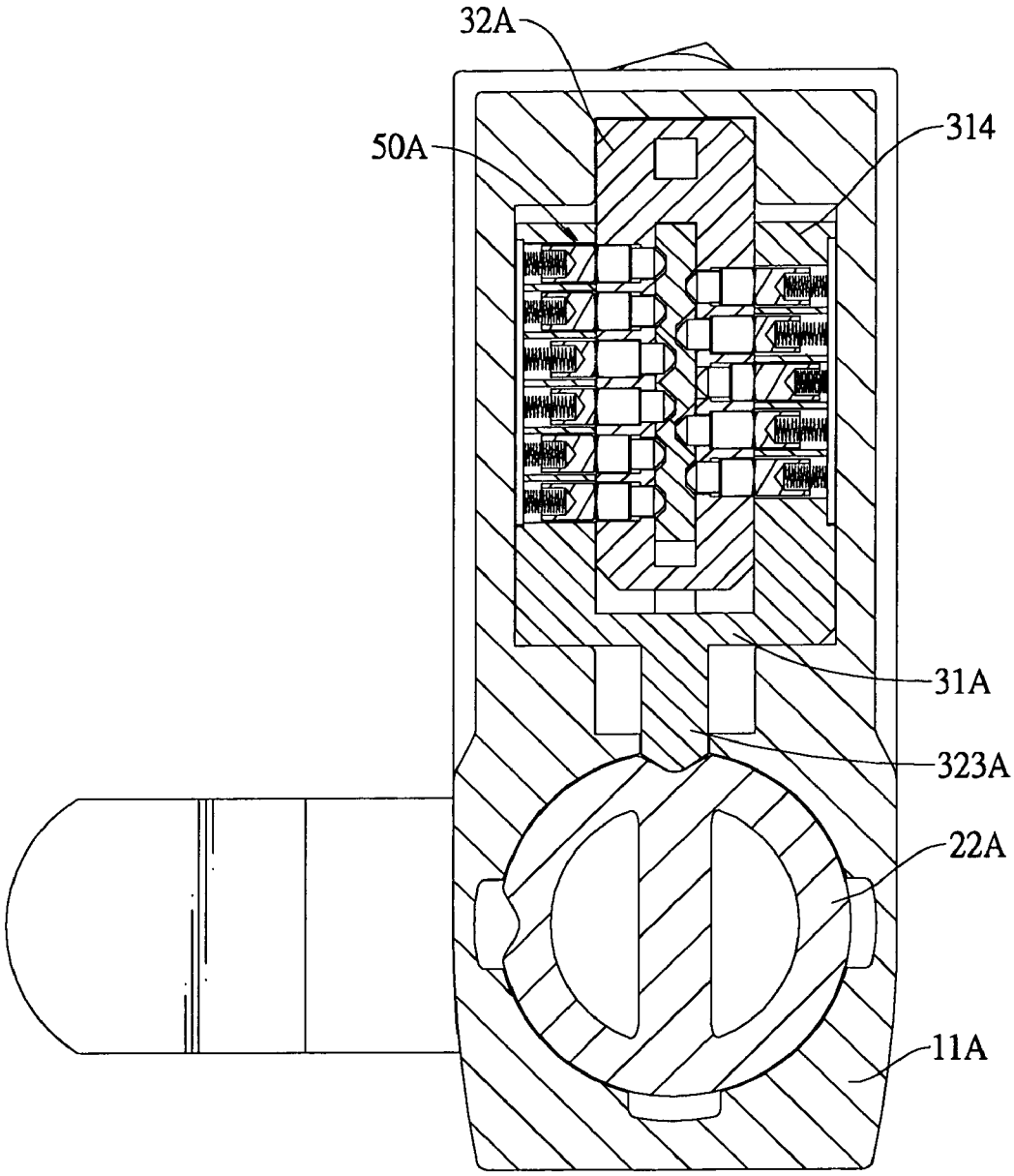
FIG. 11 is a front view in partial section of the thin lock in FIG. 10, shown unlocked.
Figure 12:
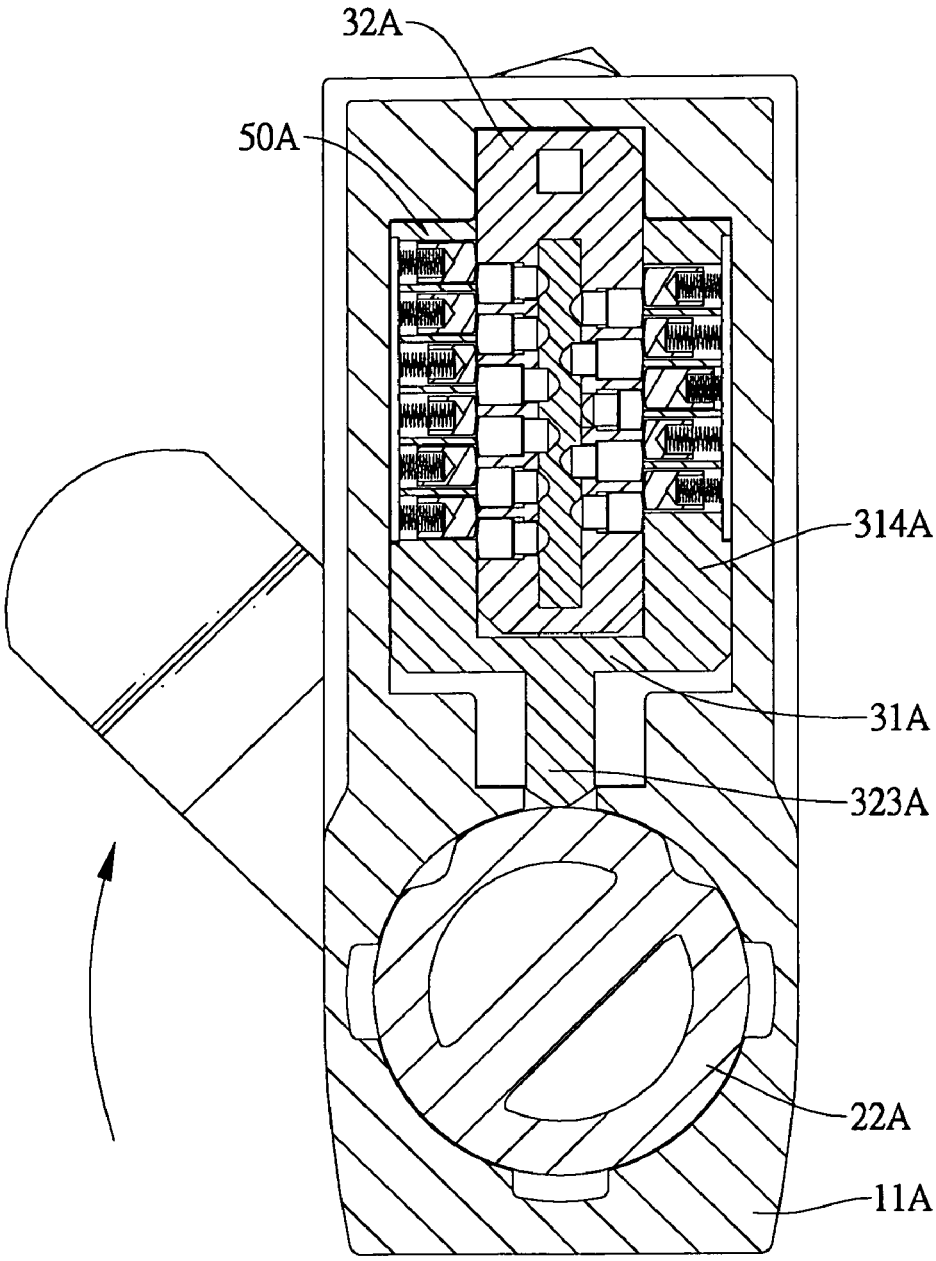
FIG. 12 is an operational front view in partial section of the thin lock in FIG. 10, shown unlocked.

With further reference to FIGS. 10 to 12, in a second embodiment, the thin lock comprises the housing 10A, the latch assembly 20A, the core assembly 30A, the main resilient element 33A and the second pin assemblies 50A. Comparing with the first embodiment, the rear half-housing 12A does not have the at least one first pin mount as described in the first embodiment, the first pin mount 311A of the first core 31A of the core assembly 30A does not have the first pin holes as described in the first embodiment, the lock protrusion 323A of the core assembly 30A protrudes down from a lower edge of the first core 31A, the second core 32A of the core assembly 30A corresponds to the at least one second pin mount 314A of the first core 31A and is attached securely to the housing 10A, and the main resilient element 33A is mounted between an upper edge of the first core 31A and the housing 10A and has two ends respectively abutting the first core 31A and the housing 10A. The second key 60A is adapted for unlock the second embodiment of the thin lock. When the second key 60A is inserted into the second embodiment of the thin lock and the driving shaft 22A of the latch assembly 20A turns, the first core 31A slides and the second embodiment of the thin lock is unlocked. Furthermore, in a preferred embodiment of the second embodiment, the first core 31A has two second pin mounts 314A.

Figure 13:
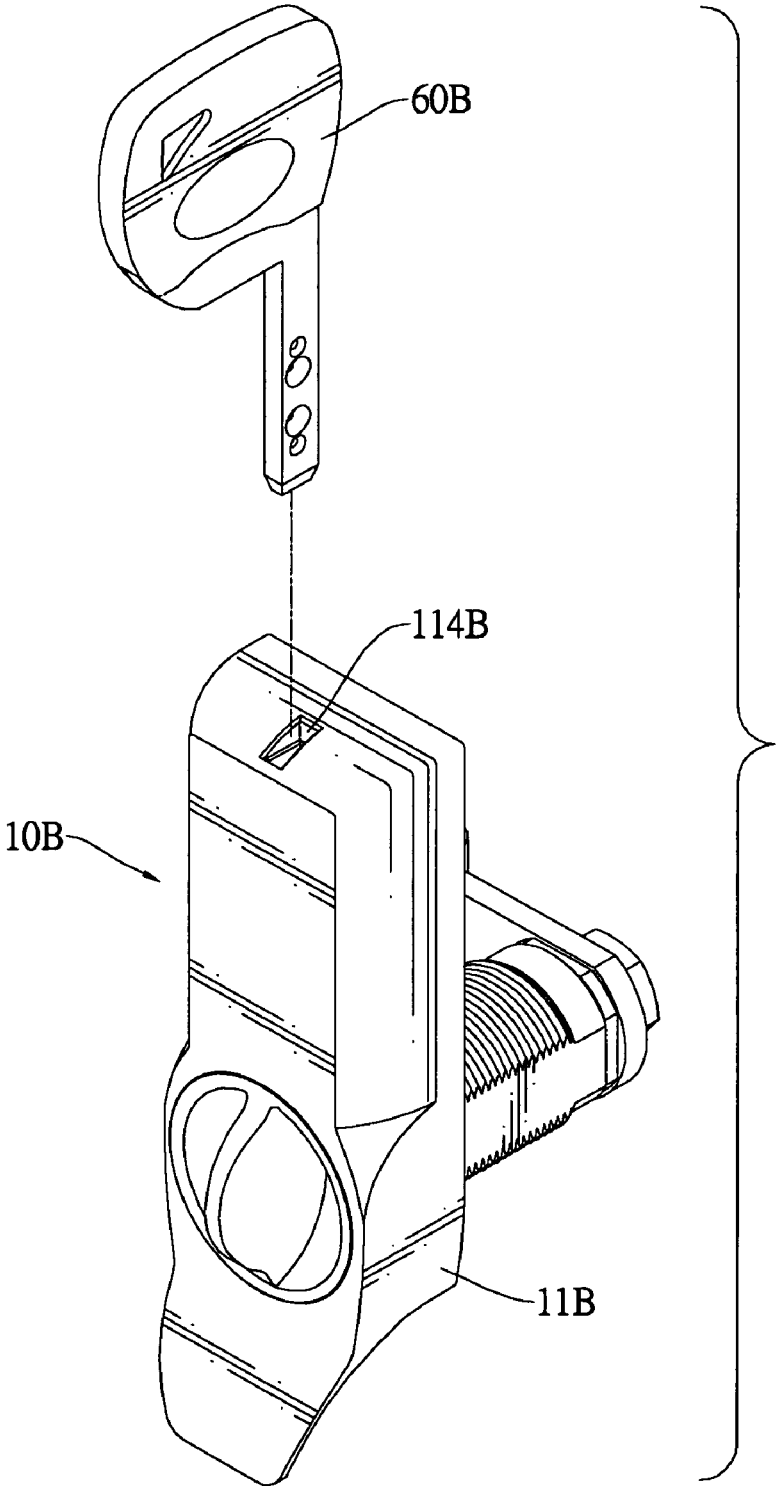
FIG. 13 is a perspective view of a third embodiment of a thin lock in accordance with the present invention and a key to the thin lock.
Figure 14:
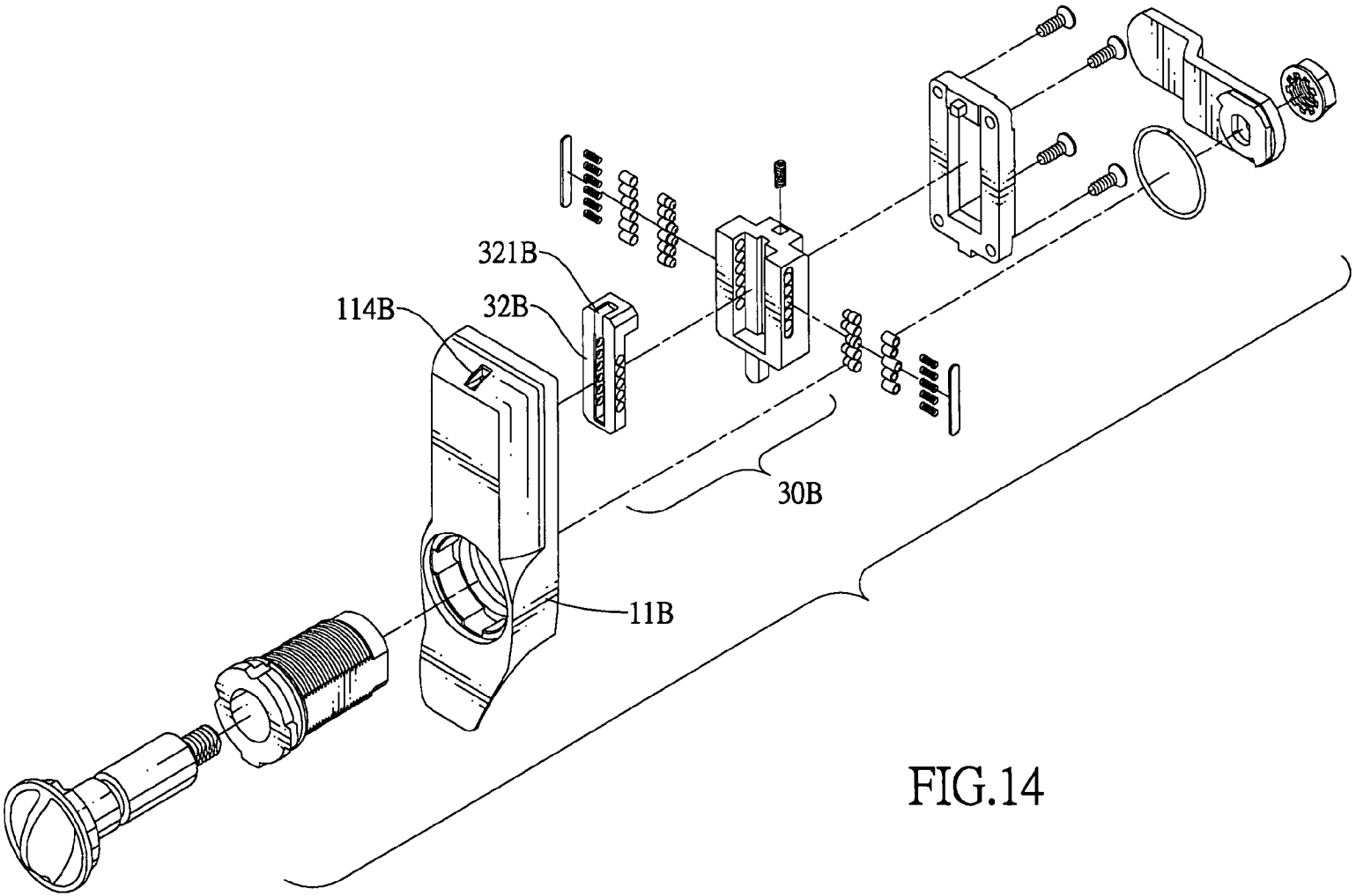
FIG. 14 is an exploded perspective view of the thin lock in FIG. 13.

With further reference to FIGS. 13 and 14, in a third embodiment, the keyhole 321B of the second core 32B of the core assembly 30B is further formed through the upper edge of the second core 32A, and the keyhole 114B of the front half-housing 11B of the housing 10B is formed through an upper edge of the front half-housing 11B and aligns with the keyhole of the second core 32B. Thus, a key 60B to the third embodiment of the thin lock is inserted into the thin lock from an upper edge of the housing 10B.

The thin lock as described has the following advantages. Since the first and second pin assemblies 40, 50 are arranged longitudinally in the housing 10, 10A, 10B, when the thin lock is mounted on the door panel, numbers of the first and second pin assemblies 40, 50 does not relate to a thickness of the door panel. Therefore, the numbers of the first and second pin assemblies 40, 50 are able to be added to increase the complexity and enhance the safety of the thin lock according to user's need.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A thin lock comprising a housing having a front half-housing having a core recess formed in a rear surface of the front half-housing;

a latch hole formed through the front half-housing;

an inner wall defined between the core recess and the latch hole;

a through hole formed through the inner wall of the front half-housing; and a keyhole formed through a front surface of the front half-housing and corresponding to and communicating with the core recess; and a rear half-housing attached to the rear surface of the front half-housing, corresponding to the core recess and having an inner surface corresponding to the core recess of the front half-housing; and at least one first pin mount formed longitudinally on the inner surface of the rear half-housing and disposed beside a sliding recess, each of the at least one first pin mount having multiple first pin recesses formed separately in the at least one first pin mount and arranged longitudinally along the at least one first pin mount;

a latch assembly mounted through the latch hole of the front half-housing and having a driving shaft mounted rotatably through the latch hole of the front half-housing and having at least one lock recess formed in a peripheral surface of the driving shaft and corresponding to the through hole of the front half-housing;

a core assembly mounted slidably in the core recess of the front half-housing and having a middle pin mount corresponding to the at least one first pin mount of the rear half-housing and having a key recess formed longitudinally in a front surface of the middle pin mount; and multiple first pin holes formed through the middle pin mount and respectively aligning with the first pin recesses of the at least one first pin mount; and a lock protrusion protrudes down from a lower edge of the core assembly, mounted through the through hole of the front half-housing, abutting the driving shaft of the latch assembly and selectively engaging the at least one lock recess of the driving shaft; and multiple first pin assemblies mounted respectively in the first pin recesses of the rear half-housing and the first pin holes of the core assembly, each first pin assembly having a first outer pin mounted in the first pin hole of the core assembly;

a first inner pin mounted in the first pin recess of the rear half-housing; and a first resilient element mounted in the first pin recess of the rear half-housing and having two ends respectively abutting the at least one first pin mount and the first inner pin.

2. The thin lock as claimed in claim 1, wherein the core assembly has a first core mounted slidably adjacent to the rear half-housing and having the middle pin mount; and at least one second pin mount formed longitudinally on a front surface of the middle pin mount and disposed beside the key recess, each of the at least one second pin mount having multiple second pin recesses formed separately in the at least one second pin mount and arranged longitudinally along the at least one second pin mount; and a second core mounted slidably adjacent to the front half-housing, corresponding to the at least one second pin mount of the first core and having a keyhole formed longitudinally through the second core and aligning with the key recess of the middle pin mount of the first core and the keyhole of the front half-housing;

an inner surface defined around the keyhole of the second core; and multiple second pin holes formed through the inner surface of the second core and respectively aligning with the second pin recesses of the at least one second pin mount;

the lock protrusion of the core assembly protruding down from a lower edge of the second core of the core assembly; and the thin lock further comprises multiple second pin assemblies mounted respectively in the second pin recesses of the first core and the second pin holes of the second core, each second pin assembly having a second outer pin mounted in the second pin hole of the second core;

a second inner pin mounted in the second pin recess of the first core; and a second resilient element mounted in the second pin recess of the first core and having two ends respectively abutting the at least one second pin mount and the second inner pin.

3. The thin lock as claimed in claim 2, wherein the rear half-housing has two first pin mounts, each first pin mount has a side surface corresponding to the side surface of the other first pin mount;

the first pin recesses of each first pin mount are formed in the side surface of the first pin mount;

the middle pin mount of the first core is mounted between the first pin mounts;

the first core has two second pin mounts formed respectively beside two opposite sides of the key recess of the first core, each second pin mount has a side surface corresponding to the side surface of the other second pin mount;

the second pin recesses of each second pin mount are formed in the side surface of the second pin mount; and the second core is mounted between the second pin mounts.

4. The thin lock as claimed in claim 2 further has a main resilient element mounted between an upper edge of the second core and the front half-housing and having two ends respectively abutting the second core and the front half-housing.

5. The thin lock as claimed in claim 3 further has a main resilient element mounted between an upper edge of the second core and the front half-housing and having two ends respectively abutting the second core and the front half-housing.

6. A thin lock comprising a housing having a core recess formed in the housing;

a latch hole formed through the housing;

an inner wall defined between the core recess and the latch hole;

a through hole formed through the inner wall of the housing; and a keyhole formed through a front surface of the housing and corresponding to and communicating with the core recess;

a latch assembly mounted through the latch hole of the housing and having a driving shaft mounted rotatably through the latch hole of the housing and having at least one lock recess formed in a peripheral surface of the driving shaft and corresponding to the through hole of the housing;

a core assembly mounted slidably in the core recess of the housing and having a first core having at least one second pin mount, each of the at least one second pin mount having multiple second pin recesses formed separately in the at least one second pin mount and arranged longitudinally along the at least one second pin mount;

a second core corresponding to the at least one second pin mount of the first core, associated with the housing and having a keyhole formed longitudinally through the second core and aligning with the keyhole of the housing;

an inner surface defined around the keyhole of the second core; and multiple second pin holes formed through the inner surface of the second core and respectively aligning with the second pin recesses of the at least one second pin mount; and a lock protrusion protruding down from a lower edge of the second core of the core assembly, mounted through the through hole of the housing, abutting the driving shaft of the latch assembly and selectively engaging the at least one lock recess of the driving shaft; and multiple second pin assemblies mounted respectively in the second pin recesses of the first core and the second pin holes of the second core, each second pin assembly having a second outer pin mounted in the second pin hole of the second core;

a second inner pin mounted in the second pin recess of the first core; and a second resilient element mounted in the second pin recess of the first core and having two ends respectively abutting the at least one second pin mount and the second inner pin.

7. The thin lock as claimed in claim 6, wherein the first core has two second pin mounts, each second pin mount has a side surface corresponding to the side surface of the other second pin mount;

the second pin recesses of each second pin mount are formed in the side surface of the second pin mount; and the second core is mounted between the second pin mounts.

8. The thin lock as claimed in claim 6 further has a main resilient element mounted between an upper edge of the second core and the housing and having two ends respectively abutting the first core and the housing.

9. The thin lock as claimed in claim 7 further has a main resilient element mounted between an upper edge of the second core and the housing and having two ends respectively abutting the first core and the housing.

10. A thin lock comprising a housing having a core recess formed in the housing;

a latch hole formed through the housing;

an inner wall defined between the core recess and the latch hole;

a through hole formed through the inner wall of the housing; and a keyhole formed through a front surface of the housing and corresponding to and communicating with the core recess;

a latch assembly mounted through the latch hole of the housing and having a driving shaft mounted rotatably through the latch hole of the housing and having at least one lock recess formed in a peripheral surface of the driving shaft and corresponding to the through hole of the housing;

a core assembly mounted slidably in the core recess of the housing and having a first core having at least one second pin mount, each of the at least one second pin mount having multiple second pin recesses formed separately in the at least one second pin mount and arranged longitudinally along the at least one second pin mount;

a second core corresponding to the at least one second pin mount of the first core, associated with the housing and having a keyhole formed longitudinally through the second core and aligning with the keyhole of the housing;

an inner surface defined around the keyhole of the second core; and multiple second pin holes formed through the inner surface of the second core and respectively aligning with the second pin recesses of the at least one second pin mount; and a lock protrusion protruding down from a lower edge of the first core of the core assembly, mounted through the through hole of the housing, abutting the driving shaft of the latch assembly and selectively engaging the at least one lock recess of the driving shaft; and multiple second pin assemblies mounted respectively in the second pin recesses of the first core and the second pin holes of the second core, each second pin assembly having a second outer pin mounted in the second pin hole of the second core;

a second inner pin mounted in the second pin recess of the first core; and a second resilient element mounted in the second pin recess of the first core and having two ends respectively abutting the at least one second pin mount and the second inner pin.

11. The thin lock as claimed in claim 10, wherein the first core has two second pin mounts, each second pin mount has a side surface corresponding to the side surface of the other second pin mount;

the second pin recesses of each second pin mount are formed in the side surface of the second pin mount; and the second core is mounted between the second pin mounts.

12. The thin lock as claimed in claim 10 further has a main resilient element mounted between an upper edge of the first core and the housing and having two ends respectively abutting the first core and the housing.

13. The thin lock as claimed in claim 11 further has a main resilient element mounted between an upper edge of the first core and the housing and having two ends respectively abutting the first core and the housing.

* * * * *